US010323376B1

(12) United States Patent
Nickelson

(10) Patent No.: US 10,323,376 B1
(45) Date of Patent: Jun. 18, 2019

(54) FLOATING DEBRIS REMOVER

(71) Applicant: David Nickelson, Forest Lake, MN (US)

(72) Inventor: David Nickelson, Forest Lake, MN (US)

( * ) Notice: Subject to any disclaimer, the term of this patent is extended or adjusted under 35 U.S.C. 154(b) by 0 days.

(21) Appl. No.: 15/731,513

(22) Filed: Jun. 21, 2017

Related U.S. Application Data

(60) Provisional application No. 62/493,182, filed on Jun. 24, 2016, provisional application No. 62/495,845, filed on Sep. 26, 2016.

(51) Int. Cl.

| | |
|---|---|
| ***E02B 15/04*** | (2006.01) |
| ***E02B 15/10*** | (2006.01) |
| ***B63B 35/32*** | (2006.01) |
| *B63B 35/34* | (2006.01) |
| *B63H 20/00* | (2006.01) |
| *B63B 21/26* | (2006.01) |

(52) U.S. Cl.
CPC ..... *E02B 15/106* (2013.01); *B63B 35/32* (2013.01); *E02B 15/046* (2013.01); *E02B 15/10* (2013.01); *B63B 21/26* (2013.01); *B63B 35/34* (2013.01); *B63H 2020/003* (2013.01)

(58) Field of Classification Search
CPC ..... E02B 15/04; E02B 15/045; E02B 15/046; E02B 15/10; E02B 15/106; C02F 2103/007; B63B 21/26; B63B 35/32; B63H 25/42; B63H 25/425
USPC ..... 210/747.6, 776, 170.05, 170.09, 170.11, 210/242.1, 923; 114/294; 440/6
See application file for complete search history.

(56) References Cited

U.S. PATENT DOCUMENTS

| | | | | | |
|---|---|---|---|---|---|
| 3,268,081 | A * | 8/1966 | Menkee | E02B 15/046 | 210/242.1 |
| 3,326,379 | A * | 6/1967 | Caddick | E02B 15/046 | 210/242.1 |
| 4,363,735 | A * | 12/1982 | Hook | E02B 15/00 | 210/242.1 |
| 4,851,133 | A * | 7/1989 | Rymal | E02B 15/046 | 210/776 |
| 5,022,987 | A * | 6/1991 | Wells | E02B 15/046 | 440/6 |
| 5,173,182 | A * | 12/1992 | Debellian | E02B 15/046 | 210/242.1 |
| 5,207,901 | A * | 5/1993 | Ravagnan | B63B 35/32 | 210/242.1 |
| 5,836,794 | A * | 11/1998 | Krueger | B63H 5/125 | 440/54 |
| 6,305,994 | B1 * | 10/2001 | Bland | B63H 25/42 | 440/6 |
| 6,669,841 | B2 * | 12/2003 | Morin | B63B 35/32 | 210/170.05 |
| 7,150,662 | B1 * | 12/2006 | Janitz | B63H 25/42 | 440/6 |

(Continued)

*Primary Examiner* — Christopher Upton
(74) *Attorney, Agent, or Firm* — Johnson & Phung LLC

(57) ABSTRACT

A floating debris remover having an operator station for directing debris into a debris inlet and a power manipulateable debris scoop for on-the-go separation of the debris from the water through elevation of the debris scoop with the debris remover having an operator station to allow an onboard operator to retrieve and deposit debris at a waste disposal site solely through operator manipulation of the debris scoop.

14 Claims, 9 Drawing Sheets

(56) References Cited

U.S. PATENT DOCUMENTS

| | | | | |
|---|---|---|---|---|
| 7,485,235 | B2 * | 2/2009 | Kellett | B63B 35/32<br>210/170.05 |
| 8,911,632 | B2 * | 12/2014 | Jarvinen | B63B 35/32<br>210/747.6 |
| 2007/0181051 | A1 * | 8/2007 | Waldrop | B63B 21/26<br>114/294 |

* cited by examiner

FLOATING DEBRIS REMOVER

CROSS REFERENCE TO RELATED APPLICATIONS

This application claims priority from provisional application Ser. No. 62/493,182 filed Jun. 24, 2016 and provisional application Ser. No. 62/495,845 filed Sep. 26, 2016.

STATEMENT REGARDING FEDERALLY SPONSORED RESEARCH OR DEVELOPMENT

None

REFERENCE TO A MICROFICHE APPENDIX

None

BACKGROUND OF THE INVENTION

One of the problems encountered with lakes or other bodies of water is that both weeds, which grow naturally in a lake, and debris, which typically accumulates around boat docks from either storms or human activity, makes the lake unsightly as well as difficult to navigate. In some cases the debris may be a harmful invasive weed species that needs to be contained and removed from the lake since the weeds can be accidently transported from lake to lake by an unsuspecting boater, which results in unwanted spread of the harmful invasive weed. Other types of debris may be the result of human activity or storm damage.

The debris problem occurs in marinas with multiple docks or in water areas where there is an isolated dock, however, in either case one needs an efficient way to remove the unsightly and polluting debris from the lake. Because of the accumulation of debris along docks and lakeshore one needs to be able to maneuver around obstacles including docks in order to remove the debris from the water. The task can be time consuming, as the debris must either be removed by hand or with bulky machines. There exists a need for an efficient operator controlled debris remover where a single person can collect and remove the debris from the lake and transfer the debris to a site for disposal.

SUMMARY OF THE INVENTION

A floating debris remover having an operator station with the debris remover having a set of pontoons with a water intake located therebetween for directing debris into an open end of a power manipulateable debris scoop having at least one screen side for on-the-go separation of the debris from the water through elevation of the debris scoop. The debris remover enables an operator in an operator station, which is located on the debris remover, to retrieve and deposit debris at a waste disposal site solely through operator manipulation of the debris scoop. In a debris retrieval mode a set of reversible electric motors may be used to control the both the speed and the direction of the debris remover as debris is pulled into a water inlet in the debris remover and the debris scoop through a propelling of the debris remover through a floating debris field. Alternately, a reversible motor may be used to draw water and debris into the water inlet in the debris remover or the reversible motor may be used to flush debris out of the debris scoop. In a transport mode a more powerful piston driven outboard motor may be used to quickly move the debris remover from a first water worksite to second water work site. The debris remover may include an anchor pole for insitu anchoring the debris remover during the discharging of the debris into a waste container.

DESCRIPTION OF THE PREFERRED EMBODIMENT

Figure 1:
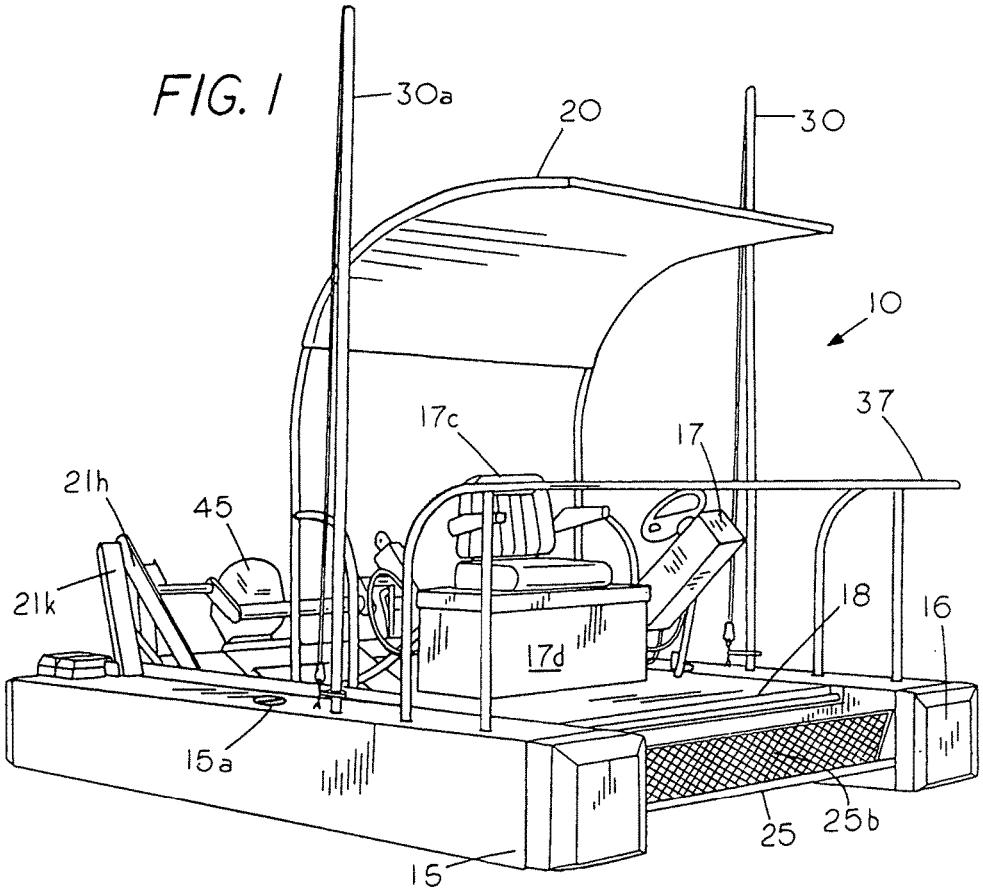
FIG. 1 is a perspective view of a floating debris remover supported by a pair of pontoons with the debris remover having a control station, a handrail, and a canopy located above a water line and a manipulateable flow through debris scoop located between the pair of pontoons in a rearward portion of the debris remover with a debris screen extending across a debris inlet in the debris remover.
Figure 8:
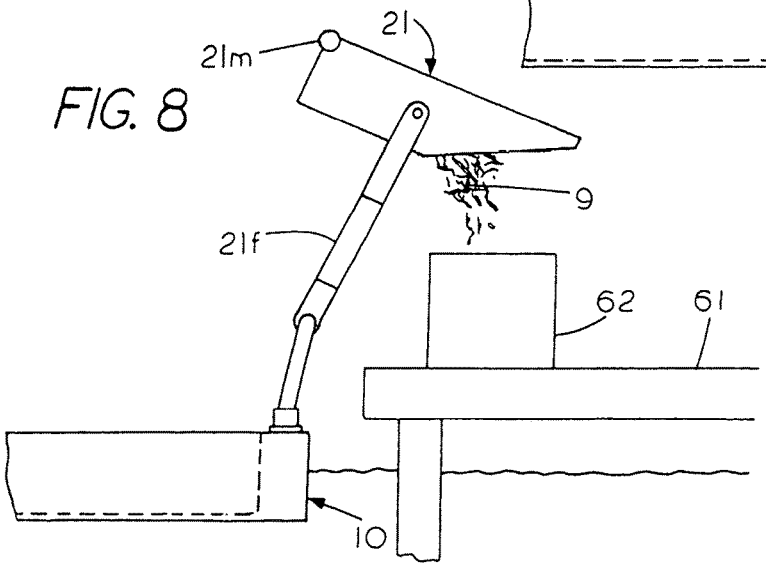
FIG. 8 is an isolated view of the debris scoop as the debris scoop empties debris into an onshore container.

FIG. 1 is a perspective view of an operator driven, floating debris remover 10 with a deck 18 supported by a pair of pontoons 15, 16 with the floating debris remover having a control station 17, a handrail 37, a storage container 17*d*, an operator seat 17*c*, a canopy 20 and an outboard motor 45. A manipulateable flow through debris scoop 21, which is located between outer pontoons 15 and 16 and in the rear of the debris remover 10, is shown in an isolated view in FIG. 3. The debris scoop is operator manipulateable through a set of pivot arms 21*k* and 21*h* and pivot arms 21*f* and 21*g* (FIG. 3), which are typically operator controlled through a first power cylinder 21*r* and a second power cylinder 21*s*, which may be hydraulic cylinders or the like. That is, the debris remover 10 lift arm 21*f* and lift arm 21*h* elevates the tiltable screen bucket or tiltable scoop 21 from a debris harvesting position between the set of pontoons (FIG. 2) to a debris empting condition proximate a refuse container 62, which is located rearward of the floatable debris remover 10 (FIG. 8).

In the condition shown in FIG. 1 a debris screen 25*b* is located in the front of a debris inlet between pontoons 15 and 16 with FIG. 1 showing the debris screen 25*b* having been rotated to an up position to prevent debris captured in the debris scoop, which is in the rear of the debris remover, from accidently flowing out of the debris scoop when the debris remover is backed up or moved to a different location. A motor well 15*a* is located in pontoon 15 and an identical motor well (not shown) is located in pontoon 16.

Figure 1A:
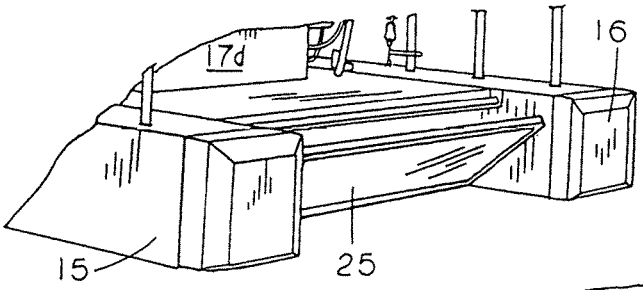
FIG. 1A is an isolated view of the floating debris remover in a travel mode with a solid front deck panel angled upward to direct water under the deck panel rather than into the debris scoop located on the top of the deck panel.

FIG. 1A is an isolated view of the floating debris remover 10 in a travel mode when the floating debris remover travels from a first water work site to a second water work site, typically under power from an outboard motor 45. The feature of an outboard motor is useful if there are long distances between work sites of if extra power is needed to move the debris remover. In the travel mode a pivotal member comprising a deck panel 25, which is shown angled upward (FIG. 1A) to direct water under the deck panel 25, which comprises a below water floor or frame that extends from pontoon 15 to pontoon 16. In the frontal deck panel 25 in the down position water flows into the water inlet 25*a* and the debris scoop 21 (FIG. 2), which is located on the top of the deck panel 25 and in the rear of the debris remover 10. In the deck panel 25 up mode the upward angled frontal panel 25 deflects water under the debris remover to reduce drag, which allows the debris remover 10 to move through the water like a conventional boat since the water flows under the debris remover rather than through the debris scoop and screens in the debris remover. In this example the pivotal member, which is the upward angled frontal panel 25 is shown in the up position in FIG. 1 and in the down position in FIG. 1A revealing frontal panel 25 is openable for allowing water to flow between the set of pontoons while retaining debris therein and closable to prevent backflow through the debris remover.

Figure 1B:
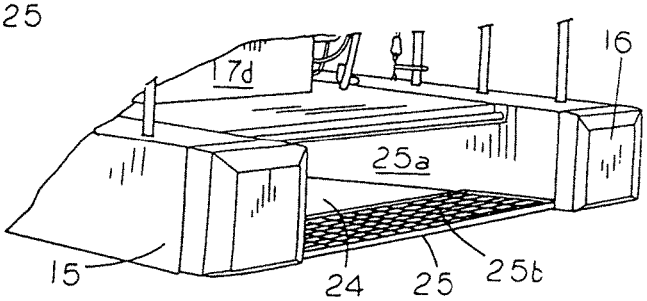
FIG. 1B is an isolated view of the floating debris remover in a debris pick mode with the front deck panel extending horizontally forward to allow water and debris to flow above the deck panel and into the debris scoop in the back of the debris remover.

FIG. 1B is an isolated and perspective view of the floating debris remover 10 in a debris pick up mode with the pivotal front deck panel 25 and the pivotal screen 25*b* extending horizontally flat so that water entering water inlet 25*a* flows above screen 25*b* and deck panel 25 and into the debris scoop 21, which is located in the back of the debris remover 10.

As can be seen in FIG. 1A and FIG. 1B the front portion of deck panel 25 is pivotable from a horizontal condition to an inclined condition through an elongated hinge (not shown). A mechanical lever or a hydraulic cylinder may be used to pivot the front portion of the deck panel 25 from the debris pick up mode shown in FIG. 1B to the travel mode in FIG. 1A. The angling upward of the front portion of the deck panel 25 directs water under the deck panel 25 preventing it from entering the debris scoop 21 thus reducing the water resistance or drag when moving the debris remover from one location to another since water passes more freely under the debris remover rather than through the internal screens located in the debris remover 10.

A feature of the debris remover 10 is that it has at least three modes of operation i.e. a debris pickup mode, a travel mode and a debris disposal mode. In the debris pickup mode the front portion of deck panel 25 extends horizontally flat in order to direct water and debris into the debris scoop 21. In the travel mode the front portion of the deck panel 25 is positionable upward to allow water to flow under the panel 25 to reduce drag. In the debris disposal mode the debris scoop 21 is lifted from the debris remover 10 as water drains from the debris scoop 21 allowing one to separate the water from the debris before emptying or disposing of the debris in the debris scoop 21.

Figure 2:
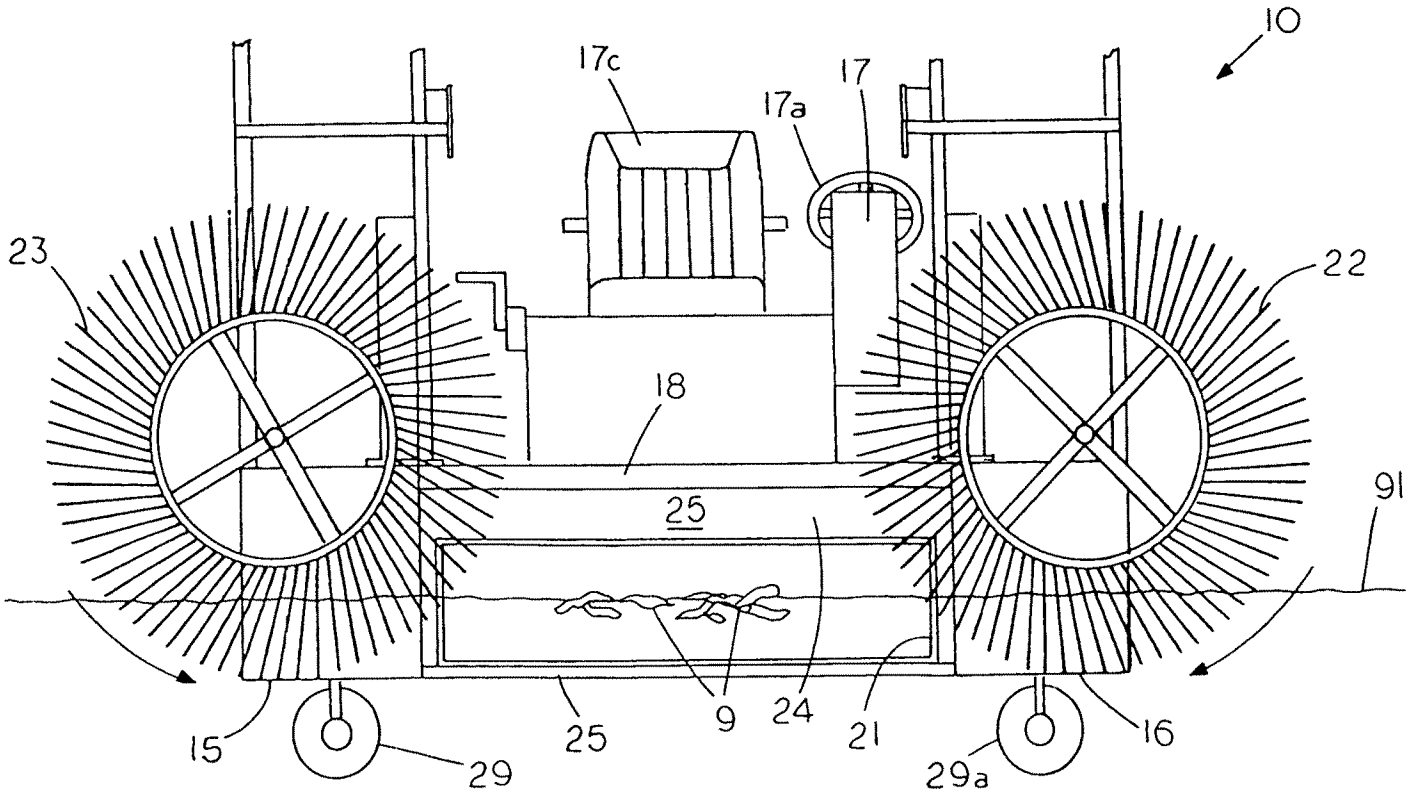
FIG. 2 is a partial front view of the floating debris remover of FIG. 1 with a set of rotatable debris reels located on opposite sides of a water inlet to the floating debris remover with the debris scoop positioned between the pontoons to trap debris as water flows through the debris scoop.
Figure 3:
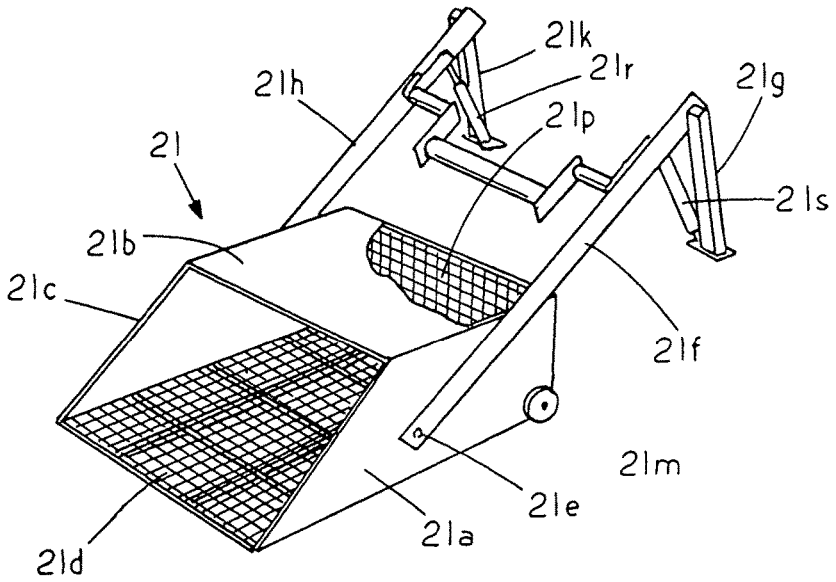
FIG. 3 is an isolated perspective view of a flow through debris scoop in a debris gathering position as water flows through the floating debris remover.

FIG. 2 is a front view of the floating debris remover 10 in a debris pickup mode with a set of rotatable debris reels 22, 23 located on opposite sides of the water inlet 24 and the debris scoop 21 centrally positioned in chamber 25*a*, which is located between the pontoons 15 and 16. In the debris pickup mode the debris remover 10 traps debris 9 therein as water flows through a porous screen in the debris scoop 21, which is shown in isolated cutaway view in FIG. 3. As shown in the example of FIG. 3 the debris scoop 21 includes solid sides 21*a* and 21*c* with a solid top 21*b*, a bottom screen 21*d* and an end screen 21*p*. The open end of debris scoop 21 allows debris and water to flow into the debris scoop and the screens in the debris scoop allows water to flow out of the debris scoop 21 while retaining the debris therein. In operation of the floating debris remover 10 the front opening or inlet 24 allows water with debris 9 to enter the debris remover 10 and debris scoop 21 where the debris 9 is collected for later disposal. In this example debris 9 is shown floating partially above and below a water line 91 as the water with debris 9 therein flows into the inlet 24 either through the action of a debris motor 55, which comprises a reversible dc outboard motor (see FIG. 10), which is located at the back of the chamber 25*a*, or through the propelling of the floating debris remover 10 through a floating debris field with the use of reversible electric outboard motors 29 and 29*a*.

Figure 2A:
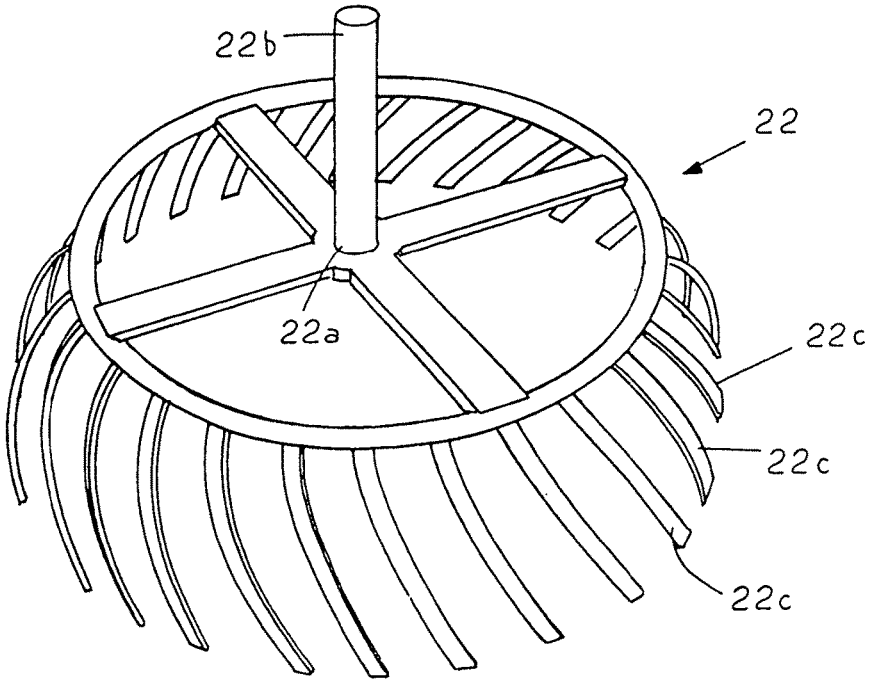
FIG. 2A is an isolated view of a debris reel with tines for directing debris into the debris scoop in the floating debris remover.

Debris reel 22 is shown in isolated view in FIG. 2A and includes a shaft 22*b* connected to hub 22*a* with a set of curved tines 22*c* positioned circumferentially around the periphery of hub 22*a*. Each of the debris reels 22 and 23 are identical and are journal mounted on the debris remover 10 for self rotation in a housing (not shown) on debris remover 10. As the debris reel 22 rotates the curved tines 22*c* of the debris reel 22 push debris toward the water inlet 24 between pontoons 15 and 16. That is, as the debris remover 10 moves through the water the flat curved tines 22*c* on the debris reel engage the water much like a water wheel causing rotation of the debris reel 22. The rotation of the debris reel 22 brings debris that is located in front of pontoon 16 into the central water inlet 24 of the debris remover where the debris 9 can be captured by the debris scoop 21, which is located in a chamber between pontoons 15 and 16 and above deck panel 25. Similarly, the water driven rotation of reel 23 operates in an identical manner to bring debris from in front of pontoon 15 into the water and debris inlet 24 where the debris can be captured by the debris scoop 21. Thus, a feature of the debris remover 10 is that the motion of the debris remover through the water is sufficient to rotate the debris wheels and direct the debris in front of the pontoons into the water and debris inlet 24. In an alternate example one may chose to power the debris reel 22 and debris reel 23 from a power source on the debris remover 10 rather than using the motion of the debris remover to power the debris reels.

While a set of debris reels 22 and 23 are shown other examples of intake devices such as paddle wheel at the front entrance of the water inlet 24 may be used. Examples of still other types of devices for directing debris into the intake may include a crank mechanism having an arm with fingers, tines or the like that pull debris into the water inlet 24, which then disengages and retracts from the debris once the debris is in front the water inlet 24. The crank mechanism would then return to pull additional debris into the debris remover. However, such mechanisms may require a power source to pull the debris into the water inlet rather than relying on the motion of the debris remover 10 as it moves through a floating debris field.

Figure 10:
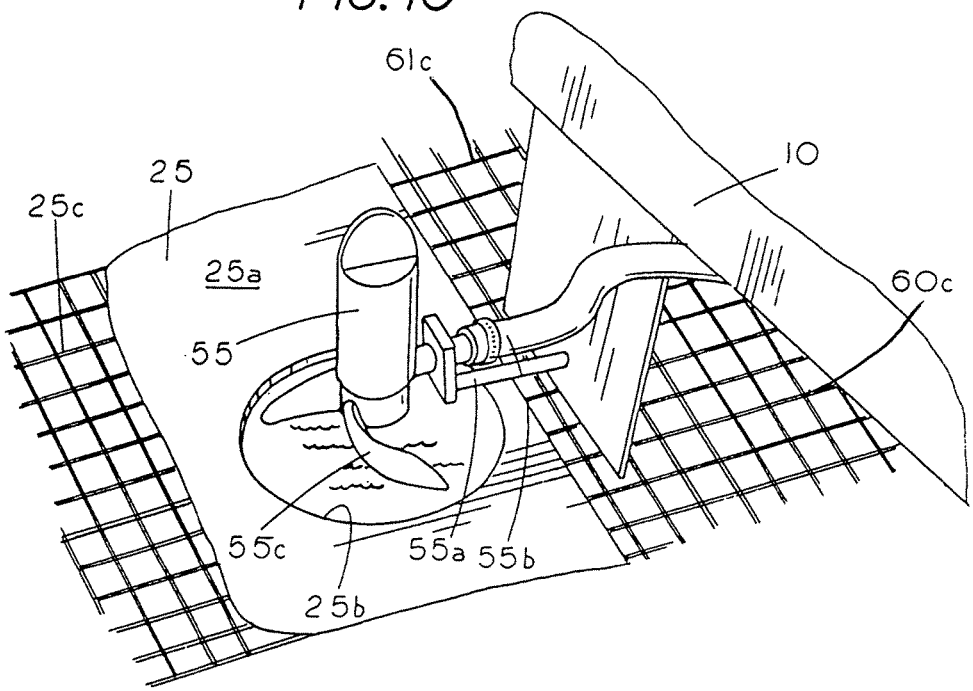
FIG. 10 is an isolated view of a rear portion of the interior of the debris remover showing a reversible dc electric motor for forcing water into or out of the debris remover.

FIG. 2 shows debris remover 10 includes a flotation support comprising a set of flotation pontoons 15 and 16 with a top cross member or deck 18 and a bottom cross member comprising a deck panel 25 to maintain the pontoons in a spaced apart position while also forming a compartment 25*a* between pontoons 15 and 16. FIG. 10 shows in isolated portion of the compartment 25*a* located in the rear of the debris remover 10 with a dc reversible outboard motor 55 located therein. An operator console 17 located between the pontoons and above deck 18 includes controls 17*a* for outboard motor 45, controls for a set of below water electric outboard motors 29 and 29*a*, controls for the electric debris motor 55 (FIG. 10) and controls for manipulating debris scoop 21. Operator seat 17*c* allows an operator therein to comfortably view debris 9 in the water as the operator guides the water intake 24 of the debris remover 10 into floating debris 9 through the use of hand controls for the electric reversible outboard motors 29 and 29*a*. A further set of controls on operator console 17 allows the operator to lift and maneuver the debris scoop 21 from a debris collecting position (see FIG. 2 and FIG. 4), where debris is collected in the debris scoop 21, to a debris unloading position, where the debris in the debris scoop is emptied into an shore waste container or onto a waste disposal area (FIG. 8).

In one debris-gathering mode the operator controls the direction of the floating debris remover 10 with a pair of dc reversible electric outboard motors 29 and 29*a* with the orientation of the motors 29 and 29*a* positionable around a vertical support axis while the speed and direction of the floating debris remover 10 is controlled by the power to each of the of dc reversible electric outboard motors 29 and 29*a*. In another mode, water with debris may be pulled into the debris scoop with reversible dc electric motor 55. Thus a feature of the invention is that in one mode the controls of the dc reversible outboard motors 29 and 29*a* allow an operator to simultaneously control both the speed and direction of the floating debris remover 10 thorough either rotational positioning of the electric outboard motors or the rotational speed of the propellers on the dc reversible electric outboard motors. Although two dc reversible outboard motors are used to move the debris remover from one location to another in some instances a single dc reversible outboard motor may be used.

In another mode a dc reversible electric outboard motor 55 can be used to draw water with debris into the debris remover 10 when the propeller 55*c* is rotated in a first direction or to flush debris out of the debris remover if the propeller 55*c* is rotated in the opposite direction, which is useful if the debris in the debris scoop 21 is deposited at a water waste site since the debris can be floated into the waste site.

Figure 11:
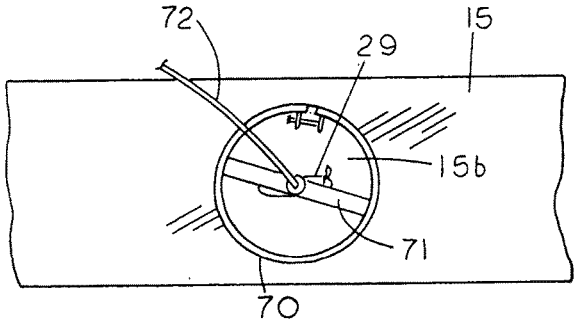
FIG. 11 is a top view of a portion of one of the pontoons of the floating debris revealing a cylindrical passage with a sidewall frictionally supporting a dc electric outboard motor therein.

FIG. 11 shows a partial sectional top view of pontoon 15 showing the dc reversible electric outboard motor 29 mounted on a diametrical strut 71, which extends across a cylindrical opening or motor well 15*b* in pontoon 15. A vertically positional motor mount 70, which comprises an expandable ring 71*c*, frictionally engages a sidewall of pontoon 15. A control cable 72 extends from electric outboard motor 29 to the control module 17 to enable the operator to control the operation of motor 29. Although not shown the dc reversible electric outboard motor 29*a* is mounted in an identical manner in a cylindrical opening or motor well in pontoon 16 with identical controls for motor 29*a* also located on control module 17. A feature of the invention is that outboard motors 29 and 29*a* can be retracted into the motor wells and out of the water when traveling between work sites. Once at the work site the outboard motors 29 and 29*a* can be extended into the water below the pontoons so that the outboard motors 29 and 29*a* can be used to power and control the direction of the debris remover 10 as the debris remover captures floating debris 17.

Figure 11A:
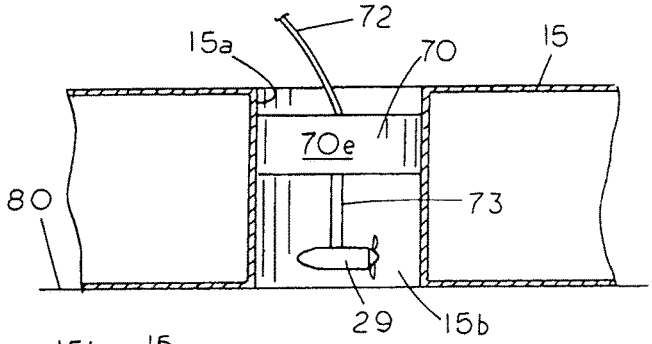
FIG. 11A is a sectional side view of a portion of a pontoon showing a sidewall of a cylindrical passage supporting a dc electric outboard motor in a stored position.

FIG. 11A shows the electric outboard motor 29 in a retracted condition with the motor mount 70 positioned upwardly in motor well 15*b* so that the electric outboard motor 29 is above a plane 80 extending along a bottom side of the pontoon 15. While not shown motor 29*a* is mounted in an identical well in pontoon 16 and above a plane (not shown) also extending along a bottom side of the pontoon 15. The retracted condition is useful when the operator transfers the debris remover 10 to another location using a more powerful piston powered outboard motor 45, which is located at the back of the debris remover, since raising the outboard motor 29 into the motor well 15*b* in pontoon 15 or outboard motor 29*a* into a motor well in pontoon 16 prevents accidental damage to the motors if there is an underwater obstruction. While a piston powered outboard motor 45 has been described as a gasoline or diesel outboard motor other types of more powerful motors may be used to propel the debris remover including an electric outboard motor or a water jet motor. Typically, the horsepower of the outboard motor is sized to the weight and the speed needed to quickly move the debris remover 10, for example to a debris site or from one debris site to another debris site. Likewise, while dc reversible outboard motors 29 and 29*a*, which are typically powered by a rechargeable 12 volt battery that is carried on the debris remover 10, have been described other types of motors or propelling devices may be used without departing from the spirit and scope of the invention. For example, a water jet motor may be mounted in the pontoon to propel and steer the debris remover 10 as debris is removed from the water.

Figure 11B:
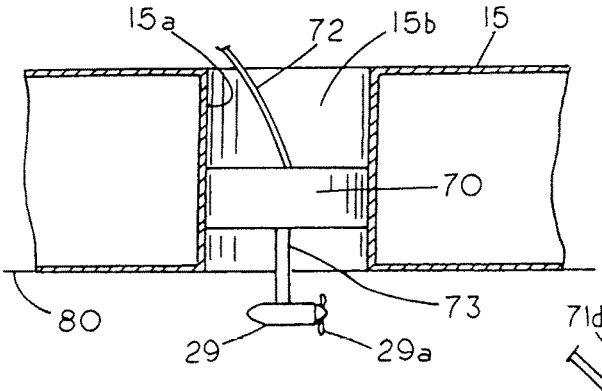
FIG. 11B is a sectional side view of a portion of a pontoon showing a sidewall of a cylindrical passage supporting a dc electric outboard motor in an operating position.

FIG. 11B shows the outboard motor 29 in an operating position below a plane 80 extending through the bottom of the pontoon 15. In the operating position the motor 29 can be remotely turned on or off or the speed of the motor varied through a cable 72 that connects to controls in control station 17. In addition, one can use the controls in control station 17 to also change the axial thrust direction of motor 29 by rotating motor 29 along a vertical axis extending through the rigid cylindrical support 73.

Figure 11C:
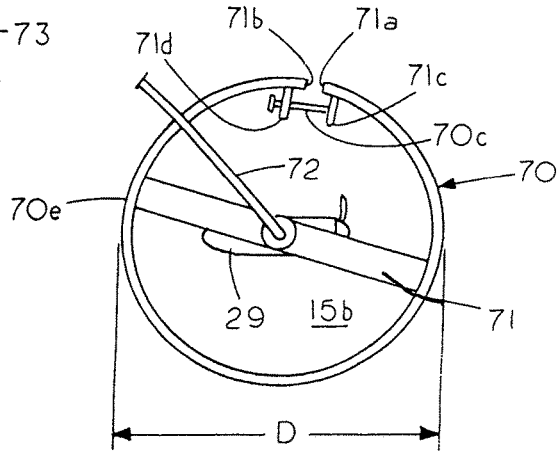
FIG. 11C is an isolated view of the electric outboard motor and the expandable housing for positioning and frictionally securing the electric outboard motor to the pontoon.

FIG. 11C is an isolated view of cylindrical motor mount 70 comprising a split ring 71 having a first end 71*b* and a second end 71*a* with a threaded member 70*c* that engages extension 71*c* and extension 71*d*. In operation rotation of threaded member 70*c* in one direction brings the ends 71*a* and 71*b* of ring 71*c* toward each other to reduce the outside diameter D of the motor mount 70. In the reduced diameter condition the motor mount 70 can be freely moved vertically up or down within the motor well 15*b* in pontoon 15 thereby allowing an operator to position motor 29 into a storage or transport condition in pontoon 15 (FIG. 11A), which is above a plane 80 extending along the bottom of the pontoon, or a run position (FIG. 11B), which is below a plane 80 extending along the bottom pontoon 15.

If the operator rotates threaded member 70*c* in the opposite direction it forces ends 71*a* and 71*b* away from each other and expands the diameter D of the cylindrical motor mount 70 bringing the motor mount cylindrical face 70*e* into frictional engagement with the cylindrical sidewall 15*a*. In the run position the frictional engagement between pontoon cylindrical wall 15*a* and cylindrical face 70*e* of motor mount 70 holds the motor in position for propelling the debris remover through the water during debris collection. Although a threaded member such as a bolt has been described other methods of expanding or contracting the diameter of the motor mount 70 may be used. For example, a pivotal latch or a solenoid may be used to expand or contract the diameter of motor mount 70. While the outboard motor 29, which is shown supported in well 15*b* in pontoon 15, has been described herein the outboard motor 29*a* is also supported in an identical manner in an identical well (not shown) in pontoon 16.

Figure 9:
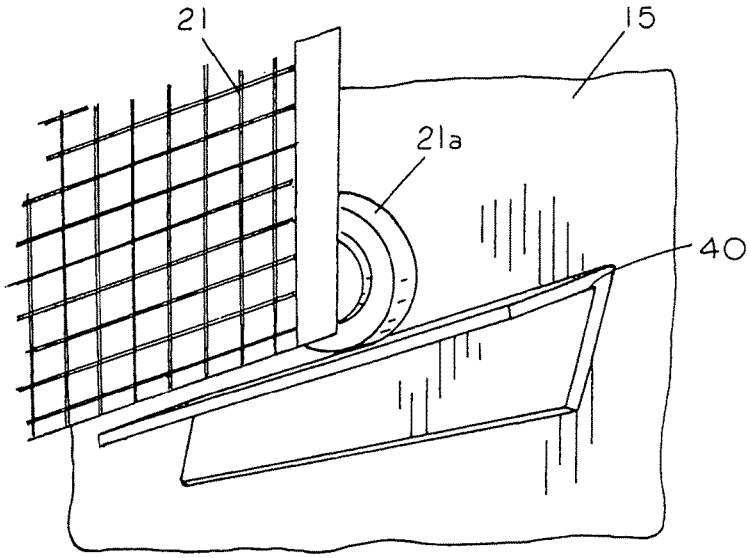
FIG. 9 is an isolated view of a corner wheel on the debris scoop engaging a ramp as the debris scoop is brought into a debris receiving position.

FIG. 2 shows the debris scoop 21 in a debris collecting position at the bottom of the floating debris remover 10 and centrally positioned between pontoons 15 and 16 while FIG. 3 is perspective isolated view of the flow through debris scoop 21, which comprise a central bottom portion formed from a screen 21*d*, having openings therein for water to flow through while retaining debris in the debris scoop 21. The debris scoop 21 is pivotally supported on one side 21*a* by a first pivot pin 21*e* and a first pivot or lift arm 21*f* which is powered by hydraulic cylinder 21*s*, and on the opposite side 21*c* by an identical pivot pin (not shown) and a second pivot or lift arm 21*h*, which is powered by hydraulic cylinder 21*r*. A set of hydraulic controls on console 20 allows an operator to pivot arms 21*h* and 21*f*. Located on the closed end of debris scoop 21 is a first guide roller 21*m* and on the opposite side a second guide roller 21*n* (see FIG. 9). Each of the guide rollers 21*m* and 21*n*, which are on opposite sides of the debris scoop 21 follow a track in the pontoon to enable the debris scoop 21 to be smoothly manipulated from the pick up or loading position to the discharge or dump position, which is located above and behind the debris remover 10. FIG. 9, which is an isolated view of a portion of the debris scoop 21 and the pontoon 15, shows a track or rail 40 secured to the pontoon 15 enabling debris scoop roller 21*n* to follow track 21, which is located on a sidewall of pontoon 15. Similarly, an identical track (not shown) on pontoon 16 supports roller 21*m* to guide the debris scoop 21 as it is moved into or out of a debris capturing position between pontoons 15 and 16.

Figure 2B:
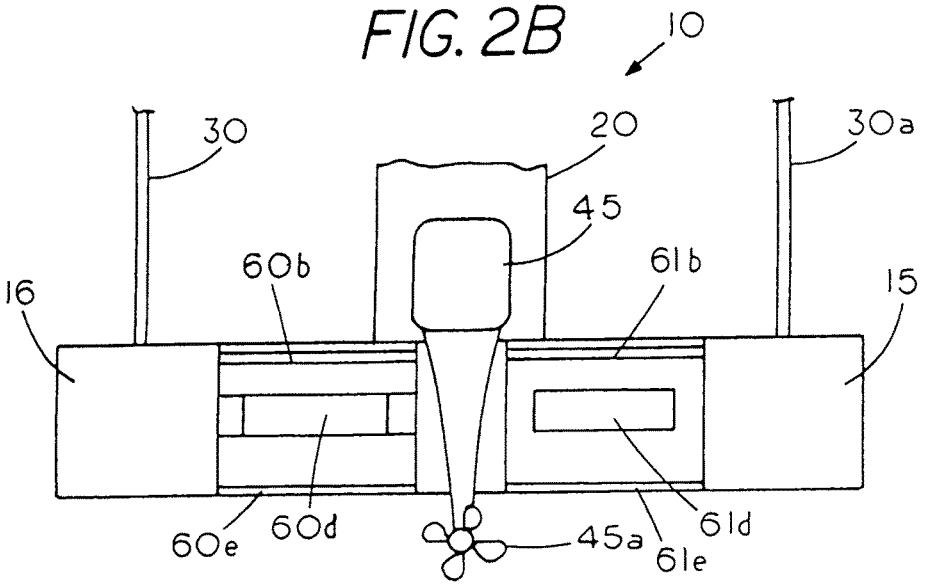
FIG. 2B is a rear view of the debris remover showing a set of rear water gates in a closed condition.
Figure 2C:
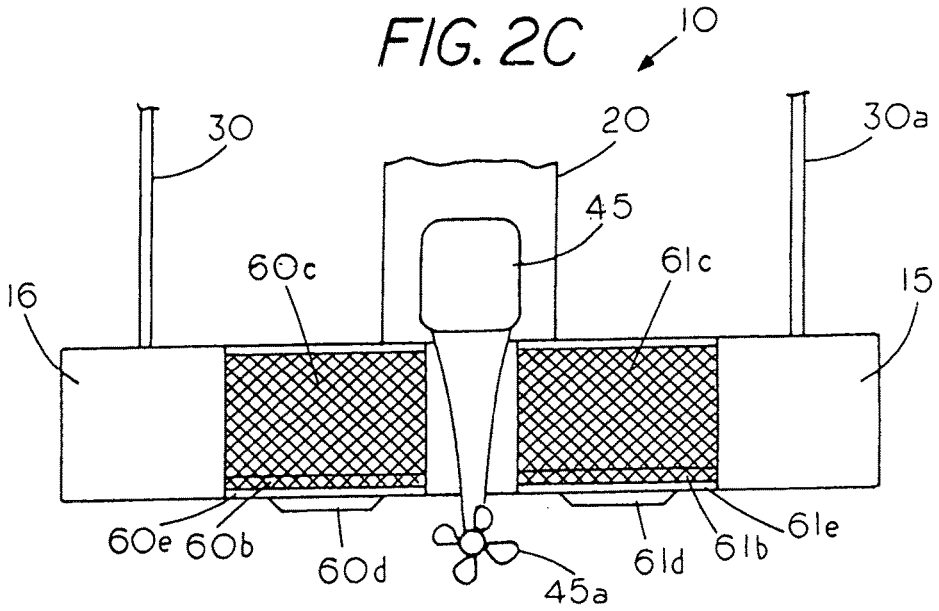
FIG. 2C is a rear view of the debris remover of FIG. 2B showing the set of rear water gates in an open condition.

FIG. 2B is a rear view of the debris remover 10 showing a set of pivotal rear water gates 60*b* and 61*b* in a closed condition with gate 60*b* having a bottom hinge 60*e* and gate 61*b* having a bottom hinge 61*e* to allow the gates 60*b* and 61*b* to rotate from a vertical closed condition as shown in FIG. 2B to an open position shown in FIG. 2C. A flotation member 60*d* attached to pivotal water gate 60*b* normally urges the water gate 60*b* into the closed condition. Similarly, a flotation member 61*d* attached to the water gate 61*b* normally urges the water gate 61*b* into the closed condition. In operation of debris remover 10 water gates 60*b* and 61*b* rotate to the open position based on the force of the flowing water through the debris remover, which allows the water to be discharged from the debris remover scoop 21 as the debris in the water is retained therein by the screen 21*p* in the debris scoop 21.

FIG. 2C is a rear view of the debris remover 10 showing the set of rear water gates 60*b* and 61*b* in an open condition revealing the screen 60*c* that is located proximate gate 60*b* and the screen 61*c* which is located proximate door 61*b*. With the rear water gates in the open condition water can be directed therethrough to flush the chamber 25*a* between the pontoons 15 and 16 with use of a reversible electric outboard motor 55 which is shown in isolated view in FIG. 10.

In operation an elongated float 60*d* on gate 60*b* pivots the gate to a closed condition when the debris remover 10 is in the water, which blocks backflow through screen 60*c*. Similarly, the float 61*d* pivots the gate 61*b* from a down condition that allows for water flow through screen 61*c* to an up condition, which blocks backflow through screen 61*c*.

FIG. 2C is a rear view of debris remover 10 showing a first pivotal end gate 60*b* and a second pivotal end gate 61*b* in the open condition or flow through condition, which allows water i.e. water with the debris removed therefrom to discharge through the screens 60*c* and 61*c* of the debris remover as the debris remover 10 moves forward through the water. Thus, a forward motion of the debris remover 10 causes the end gates 60*b* and 61*b* to be maintained in the open condition. Conversely, when the debris remover 10 is stopped or the motor 55 is in an intake position operation or when the debris remover is backing up the float 60*d* in end gate 60*b* and the float 61*d* end gate 61*b* pivot the end gates 60*b* and 61*b* to a closed condition (FIG. 2C) so collected debris, which is within the debris remover 10, will not flow out the front 24 of the debris remover.

FIG. 10 shows the reversible electric outboard motor 55 supported in a fixed vertical position on debris remover 10 with a bracket 55*a* that extends from the motor 55 to the top frame 10*c*, which is supported by pontoon 15 and pontoon 16. A conduit 55*b*, which contains the control lines for reversible electric outboard motor 55, extends outward from motor 55 and terminates at control station 17 (FIG. 1) to enable an operator at control station 17 to remotely turn outboard motor 55 on or off as well as to reverse the rotation of the propeller 55*c* on outboard motor 55. The reversible outboard motor 55 is positioned vertically at the rear of the debris remover and in front of the screen 60*c* and 61*c* with propeller 55*c* located above a circular opening 25*b* in deck panel 25, which is typically as large as the diameter of the propeller 55. When the debris remover 10 is in water the propeller 55*c*, the floor panel 25 and the floor screen 25*c* and a portion of the outboard motor 55 are also in water i.e. below the water line. Rotating the propeller 55*c* on the electric outboard motor 55 in one direction draws water into the compartment 25*a* above floor panel 25 through the opening 25*a* while rotating propeller 55*c* in the opposite direction forces water out of chamber 25*a* through the opening 25*b* in floor panel 25.

Thus, in one mode motor 55 pushes water from the back of the debris remover 10 to a front opening 24 (FIG. 1) in the debris remover 10, which allows one to flush debris from the debris remover 10 through the front opening 24 of the debris remover 10. This feature is useful if the debris, which is captured in the debris remover, is transferred to a water site, for example, one may transfer lake debris from one water location to another water location without having to use the debris scoop 21 to unload the debris.

When the rotation of the propeller 55*c* on reversible electric outboard motor 55 is reversed i.e. so that the propeller 55*c* draws water through the floor opening 24 in the debris remover 10, the motor 55 can be used to retain the debris in the debris water scoop 21 therein through the force of the flowing water through the debris scoop 21. This feature allows debris in the debris remover 10 to remain therein until time for disposal even though the front opening 24 of the debris remover may be in an open condition. The controls for the reversible electric outboard motor 55 are conveniently mounted on operator console 20 with a rechargeable battery (not shown) conveniently located inside the operator cabinet 17*d* to provide power for each of each of the three reversible dc electric outboard motors 55, 29 and 29*a*.

FIG. 1 shows debris remover 10 includes a front handrail 37 and a canopy 20, which is sometimes referred to as a bimini. The canopy 20, which is supported by a rigid frame, provides shelter to the operator as well as a safety shield to protect the operator in the event any debris should fall from the debris scoop 21 as the debris scoop 21 is emptied into a waste container.

In the embodiment shown a first telescoping anchor pole 30*a* extends through pontoon 15 with anchor pole 30*a* engageable with the ground and an identical telescoping anchor pole 30 extends through the pontoon 16 on the opposite side of the debris remover 10 to provide for quick and rapid insitu anchoring of the debris remover.

Figure 12:
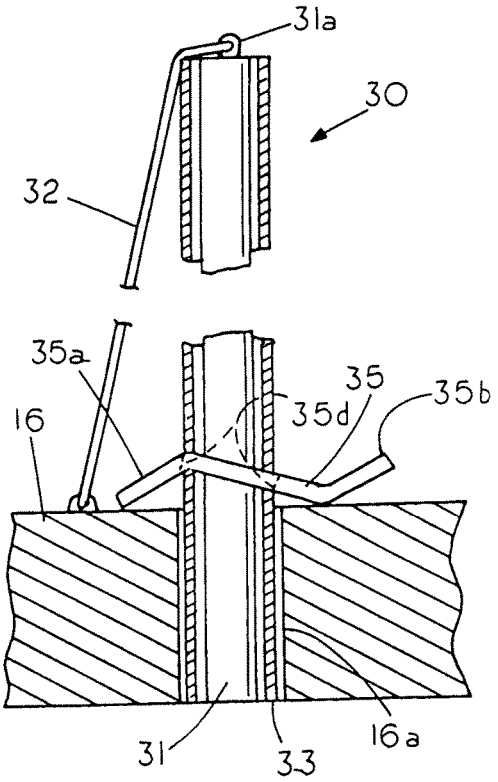
FIG. 12 is a partial sectional view of a telescoping anchor pole in the up position.

FIG. 12 shows in detail the first telescoping anchoring pole 30, which is located on a front end of pontoon 16. An identical telescoping anchoring pole 30*a* is located on the front end of pontoon 15 with each of the telescoping anchoring poles, which are sometimes referred to as spuds, extending through a cylindrical housing in the pontoon. Telescoping anchoring pole 30 is shown in cross section in FIG. 12 and FIG. 12*a* and comprises an inner pipe 31 that slides freely within pipe 33, which can slide freely within cylindrical housing 16*a*. A rope 32, which has one end affixed to the pontoon 16 and the other end to pipe 31 prevents the inner pipe 31 from sliding through pipe 33. A pivotal or tiltable yoke 35 which is supported by pontoon 16, includes a central ring 35*d* (FIG. 12*b*) normally located an acute angle with respect to pipe 33. The angular position of yoke 35 with respect to pipe 33 creates frictionally engagement between the cylindrical surface of outer pipe 33 and the ring 35*d* to hold pipe 33 in an upright position while the rope 32 retains the inner pipe 31 in the upright position shown in FIG. 5.

Figure 12A:
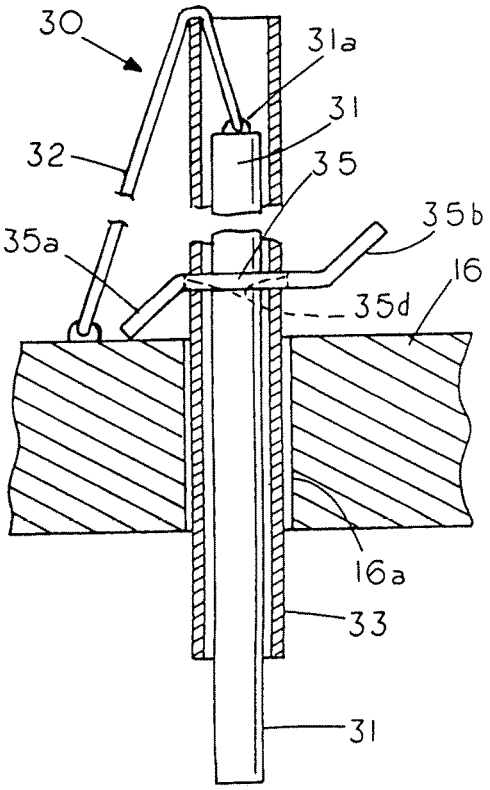
FIG. 12A is a partial sectional view of a telescoping anchor pole in the down or anchor position.

FIG. 12*a* reveals that to lower the telescoping anchor pole 30 one lifts end 35*b* of yoke 35 upward, which brings the ring 35*d* in yolk 35 and the outer pipe 33 into axial alignment. Since the ring 35 has a larger diameter than the outer pipe 33 the alignment allows the outer pipe 33 to slide downward through housing 16*a*. As pipe 33 slides downward the inner pipe 31, which is held by the top of the outer pipe 32 by a rope tied to pontoon 16, also slides downward within pipe 33 so that the telescoping anchor pole 30 with inner pipe 31 and outward pipe 33 extend downward below the bottom of pontoon 16 as shown in FIG. 12A. The end of the telescoping anchor pole 30 can be used to engage the lake bottom and hold the debris remover 10 in position for waste removal as shown in FIG. 8. To raise the telescoping anchor pole 30 one merely grasps the outer pipe 33 and lifts the pipe 33, which disengages the yoke 35 and allows the pipe to be raised upward. Releasing the pipe 33 causes the yoke 35 to again engage with the pipe 33 and hold the pipe 33 in position. In this embodiment identical telescoping anchor poles are located on each pontoon with each of the telescoping anchor poles ground engageable for anchoring the floating debris remover 10 while debris is being transferred from the debris scoop or debris bucket 21 to a waste container. To disengage the telescoping anchor pole 30 or 30*a* from the anchoring condition one merely lifts the outer pipe, which releases friction yoke 35 and allows one to bring the telescoping anchor pole out of lakebed engagement.

Figure 12B:
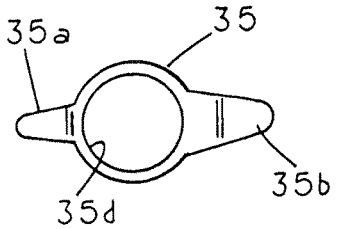
FIG. 12B is a top view of a yoke for frictionally engaging the telescoping anchor pole.

FIG. 12B is an isolated top view of the pivotal yoke stop 35 for either axially restraining the telescoping anchor pole 30 in a fixed vertical position or for allowing the anchor pole 30 to slide therethrough when the yoke stop 35 is pivoted to a horizontal position as shown in FIG. 12A. Yoke stop 35 include a first extension or leg 35*a* on one side and a second extension or handle 35*b* on the opposite side with an intermediate ring 35 having an inner surface that is slightly larger than the diameter of pipe 33 so that when the ring 35 is in axial alignment with the pipe the piper 33 can slide freely therewith (FIG. 12A) but when ring 35 is an angle to pipe 33 (FIG. 12) the pipe 33 and the ring 35 frictionally engage each other to retain the anchor pipe 33 in pontoon 16 as shown in FIG. 12.

Figure 12C:
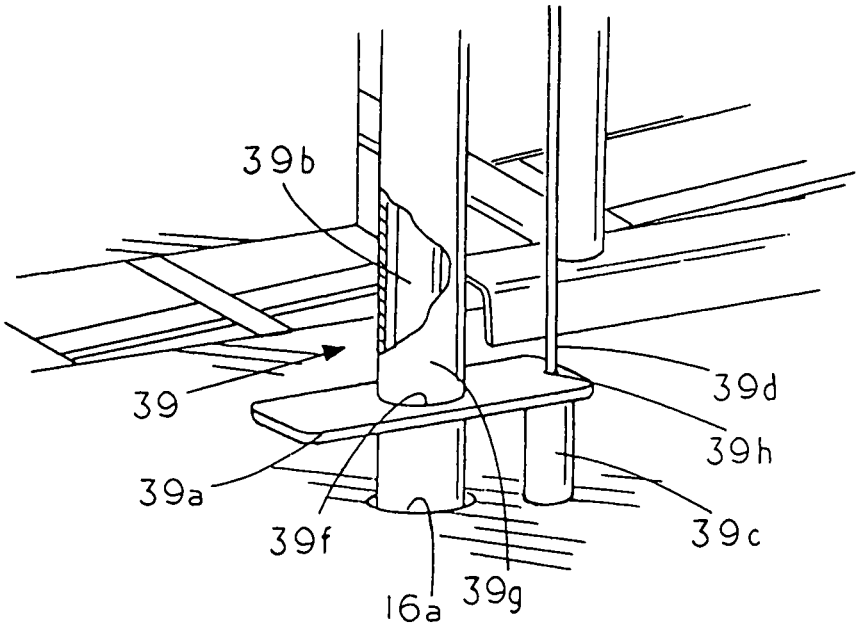
FIG. 12C is a perspective of an alternate embodiment of a yoke and a telescoping anchor pole.

FIG. 12C shows an alternate embodiment of a telescoping anchor pole 39 having an inner pipe 39*b* that sliding fits within outer pipe 39*g*. In this example a flat plate 39*a* having an opening larger than the diameter of outer pipe 39*g* allows the pipe 39*g* to slide therethrough when the plate 39*a* is perpendicular to the pipe 39*g*. In the normal or holding condition the rope 39*d*, which is located in a slot 39*h* in plate 39*a* connects to the top end of inner pipe 39*b*. The weight of pipe 39*b* pulls upward on blade 39*a*, which brings the plate 39*a* at an angle to pipe 39*g* thus binding with the pipe to prevent the pipe from sliding through the opening 39*f* in plate 39*a*. A compressing spring 39*c* is located at the end of rope 39*d* and engages the plate 39*a* proximate a slot 39*h*. The compressing spring 39 provides a cushion to absorb energy and stop the axial displacement of pole 39*b*. A feature of this telescoping anchor pole 30 or anchor pole 39 is that both sets of anchoring poles both can be lifted out of an opening in the pontoon for storage of the telescoping anchor poles when trailering the debris remover from one location to location.

Figure 4:
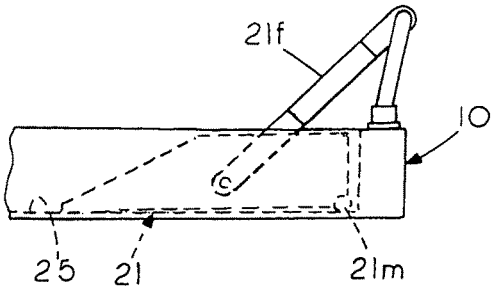
FIG. 4 is an isolated view of the debris scoop of FIG. 3 in a debris receiving position at the rear of the debris remover.

The debris scoop 21, which is shown in an isolated view in FIG. 3, is shown in various positions in FIG. 4 to FIG. 8 as the debris scoop moves from a pick up position illustrated in FIG. 4 to a dumping or emptying position illustrated in FIG. 8. As the debris scoop 21 is lifted and rotated the water in the debris scoop 21 water flows through the porous screens 21*c* and 21*p* while the debris remains in the debris scoop 21.

Figure 5:
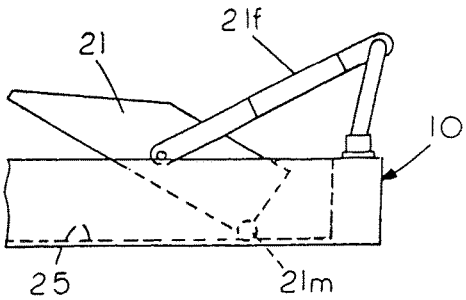
FIG. 5 is an isolated view of the debris scoop as it begins an emptying cycle.

FIG. 5 reveals how the debris scoop 21 begins to rotate clockwise as the arm 21*f* lifts the debris scoop 21 upward. As FIG. 4 and FIG. 5 show the roller 21*m* and the roller 21*n* (FIG. 9) allow the bottom of the debris scoop 21 to move laterally along the bottom panel 25 of the debris remover 10 as the debris scoop is lifted upward. FIG. 5 shows that as the debris scoop 21 moves to an intermediate vertical orientation of the debris scoop the back and side of the debris scoop 21 are supported and guided by a first roller 21*m* on one side of scoop 21 and a second roller 21*n* on the opposite of scoop 21 and 21*n* that rolling engage the bottom panel 25 (FIG. 2 and FIG. 10) as well as tracks on the pontoons.

Figure 6:
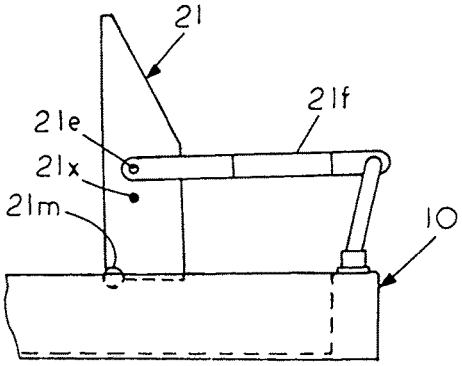
FIG. 6 is an isolated view of the debris scoop being lifted out of the floating debris remover.

FIG. 6 is a side view showing a later intermediate position of the debris scoop 21 with the flow through debris scoop 21 in an upright or vertical position as scoop 21 is elevated on one side by arm 21*f* and on the opposite side by an identical arm 21*k* (FIG. 3). The location of the pivot pin 21*e* and an identical pivot pin (not shown) on opposite side 21*c* with respect to the center of gravity 21*x* of the debris scoop holds the debris scoop 21 in an upright position with the open end of the debris scoop 21 facing upward so as to retain the debris therein as the debris scoop 21 is rotated to the debris dumping or emptying position, which is shown in FIG. 8. That is, in the position shown in FIG. 6 the pivot pins are located above the center of gravity 21*x* of the debris scoop 21 enabling the debris scoop to hang vertically as shown with the open end facing upward. As the debris scoop 21 enters the vertical position the scoop 21 continues to hang vertically and any water in the debris scoop begins to drain through the screens 21*d* and 21*p* (FIG. 3) while the screens 21*d* and 21*p* retain the debris in the debris scoop 21. While the preferred positioning of the pivot pins may be above the center of gravity for a free hanging debris scoop the use of a latch or the like on the debris scoop allows freedom in positioning the debris scoop for emptying.

Figure 7:
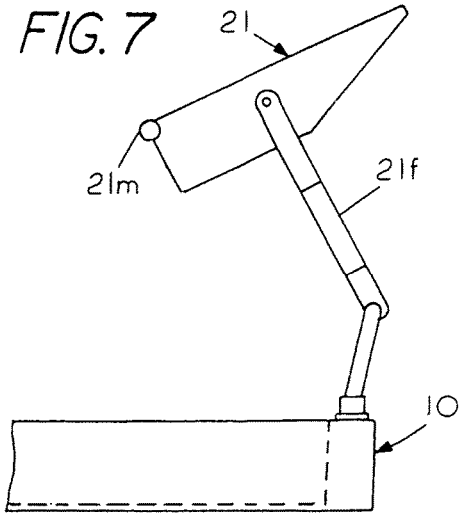
FIG. 7 is an isolated view of the debris scoop as the debris scoop moves toward an empting position.

FIG. 7 shows that as the debris scoop 21 continues the emptying cycle, the debris scoop to moves to the rear of the debris remover 10 while the debris scoop 21 remains in an upright condition with the mouth of the debris scoop facing upward so as to retain debris within the debris scoop 21.

FIG. 8 is a side view section showing the flow through debris scoop 21 in the debris emptying position as the debris scoop 21 is rotated clockwise to empty the contents into an onshore container 62 on dock 61. The emptying through rotation of the debris scoop 21 may be done by the operator tilting the debris scoop with his or her hands or controls may be used, for example, a hydraulic motor or hydraulic cylinder to rotate the debris scoop 21 to the emptying position in response to a control signal from control module 21.

As can be seen in FIG. 4 to FIG. 8 the debris scoop 21 is pivotally supported in an upright position to retain debris therein as the debris remover moves from a pickup position (FIG. 4) to a dumping or emptying position (FIG. 8). When the emptying or dumping position is reached the debris scoop 21 is pivoted to an emptying position either by hand or by a power cylinder (not shown).

In operation of the example shown herein the pivot pin 21*e* on bucket 21 as well as a pivot pin (not shown) on the opposite side of debris scoop 21 are positioned proximate the center of gravity of the debris scoop 21 such that the empty weight of the debris scoop 21 normally causes the debris scoop to hang with the open facing upward as shown in FIG. 3. Consequently, any debris material in the debris scoop adds to the self-righting feature of the debris scoop 21. However, when the debris scoop is in the dumping position a further rotation of debris scoop 21 causes the debris therein to fall into the container 62 on dock 61. Once the debris is dumped or emptied into container 62 the debris can be properly disposed.

In the embodiment shown in FIG. 4 the debris scoop 21 is located in a horizontal condition on top of deck 25, however, in operation one may prefer to elevate the rear of the debris scoop so the debris scoop rests at a slight angle for debris capture. Similarly, another feature of the invention is the pivoting end gates 60*b* and 61*b*, which are shown in the open position in FIG. 2C and in the closed position in FIG. 2B, may be locked in the closed position through either a mechanical or solenoid powered latches (not shown). Also when the plate 39*a* held in the horizontal position, as shown in FIG. 12C, the pipe 39*g* is free to slide therethrough, however, when plate 39*a* is allowed to form an angle to the horizontal i.e. through support of one end plate 39*a* with spring 39*c* the angled engagement between the cylindrical pipe 39*g* and the cylindrical hole 39*f* in the plate frictional supports pipe 39*g* therein.

I claim:

1. A floating debris remover comprising;

a set of flotation pontoons each having a motor well located therein;

a first electric outboard motor with a water propeller located in the motor well of one of the pontoons and a second electric outboard motor with a water propeller located in the motor well of the other pontoon for propelling and steering the debris remover in a body of water;

a control module for varying a thrust of each of the electric outboard motors where the varying of the thrust is used to control the direction of the floating debris remover;

a piston driven outboard motor located on the aft of the floating debris remover for moving the floating debris remover from site to site;

a set of cross members maintaining said flotation pontoons in a spaced apart condition;

a pivotal member openable for allowing water with debris to flow between the set of pontoons and closable to prevent backflow through the debris remover;

an electric debris motor with a water propeller for pulling water between the pontoons to retain debris in the floating debris remover;

a telescoping anchor pole with said telescoping anchor pole ground engageable for anchoring the floating debris remover;

a tiltable screen scoop having an open end for debris to flow therein;

a lift arm for elevating the tiltable screen scoop from a debris harvesting position between the set of pontoons to a debris empting condition proximate a container located rearward of the floatable debris remover; and an operator seat and a set of controls located on said floating debris remover to enable an operator to control the operation of the flowing debris remover.

2. The floating debris remover of claim 1 wherein the electric debris motor is located between the set of pontoons for drawing water into an inlet in the debris remover.

3. The floating debris remover of claim 1 wherein the telescoping anchor pole includes a tiltable yoke for frictionally and axially restraining the telescoping anchor pole.

4. The floating debris remover of claim 1 including a guide rail for engaging and guiding the tiltable screen scoop during an elevation or retraction of the tiltable screen scoop.

5. A floating debris remover including:

a frame having flotation support;

a chamber located in said frame;

a debris inlet located in one end of the debris remover;

at least one motor for propelling the debris remover;

a debris scoop located in the chamber with the debris scoop having openings therein for separating debris from water as water with debris therein flows into the debris scoop through the debris inlet;

a lever arm for lifting the debris scoop from a debris capturing position in the debris remover to a debris emptying position;

a pivotal end gate located on one side of the motor and a further end gate located on an opposite side of the motor with the pivotal end gate on an aft region of the debris remover with the pivotal end gate having an open condition to allow water to flow out the aft region of the debris remover or a closed position to prevent flow into the aft region to prevent debris that has been captured within the debris remover from flowing out of the debris remover;

the pivotal end gate and the further end gate pivotable to a closed condition when the debris remover is stopped or backing up;

and an operator station located on the debris remover.

6. The debris remover of claim 5 including at least one water powered rotatable reel located in front of the debri remover for directing debris into the debris inlet in the debris remover.

7. The debris remover of claim 6 including a pivotal panel located at the debris inlet with the tiltable panel tiltable upward to direct water under the panel as the debris remover is transferred to another site and tiltable to a horizontal condition to direct water and debris into the debris scoop located in the debris remover.

8. The debris remover of claim 5 including a deck panel in said frame with said deck panel having an opening therein; and a reversible debris motor located in a chamber above the opening with the reversible debris motor having a propeller rotatable in a first direction to pull water through the opening the debris scoop located in the chamber and rotateable in an opposite direction to force water out of the debris scoop located in the chamber.

9. The debris remover of claim 5 where the flotation support comprise a first elongated pontoon located on one side of the frame and a second elongated pontoon located on the opposite side of the frame.

10. The debris remover of claim 5 including at least one telescoping anchor pole extendable through the flotation support on the debris remover for insitu anchoring.

11. The debris remover of claim 5 including a pair of dc reversible motors for controlling the position of the debris remover during debris removal from a body of water wherein a one of the pair of the pair of dc reversible motors is located on a first side of the debris remover and an other of the pair of dc reversible motors is located on an opposite side of the debris remover.

12. The debris remover of claim 5 including a motor well in the flotation supporting for supporting a dc reversible motor therein with the motor well extending through the flotation support.

13. The debris remover of claim 5 wherein the debris scoop includes a pair of wheels for rolling engagement with the frame of the debris remover as the debris scoop is elevated from or returned to the chamber in the debris remover.

14. The debris remover of claim 5 including at least one vertically positional motor mount located in a motor well in the flotation support.

* * * * *